US008367180B2

(12) United States Patent
Roberts

(10) Patent No.: US 8,367,180 B2
(45) Date of Patent: Feb. 5, 2013

(54) COLD CHAIN PACKAGING

(75) Inventor: David Roberts, Aptos, CA (US)

(73) Assignee: Monterey Bay Associates, Aptos, CA (US)

( * ) Notice: Subject to any disclaimer, the term of this patent is extended or adjusted under 35 U.S.C. 154(b) by 586 days.

(21) Appl. No.: 12/508,803

(22) Filed: Jul. 24, 2009

(65) Prior Publication Data

US 2010/0018983 A1 Jan. 28, 2010

Related U.S. Application Data

(60) Provisional application No. 61/083,814, filed on Jul. 25, 2008.

(51) Int. Cl.
*B65B 55/00* (2006.01)
*B65D 81/38* (2006.01)
*B65D 61/02* (2006.01)

(52) U.S. Cl. ..... 428/76; 82/457.7; 428/68

(58) Field of Classification Search ..... 428/76, 428/68; 62/457.7
See application file for complete search history.

(56) References Cited

U.S. PATENT DOCUMENTS

2005/0210912 A1 * 9/2005 Mogil et al. ..... 62/457.7

* cited by examiner

*Primary Examiner* — Brent O'Hern
(74) *Attorney, Agent, or Firm* — Greer, Burns & Crain, Ltd.

(57) ABSTRACT

A cold chain package including a plurality of panels surrounded by an overwrap, each of the panels including a plurality of layers of dissimilar materials, and a hinge formed between adjacent panels of the plurality of panels for facilitating folding of the panels to fit in a shipping container.

9 Claims, 3 Drawing Sheets

COLD CHAIN PACKAGING

This application claims priority under 35 USC 119(e) from Provisional Application Ser. No. 61/083,814 filed Jul. 25, 2008.

BACKGROUND

The present invention relates generally to thermally insulated packaging, and more specifically to packaging designed for maintaining packaged items in a refrigerated state.

There is an increasing demand for so-called "cold chain" packaging that is suitable for maintaining items at temperatures in the range of 34-48° F. for at least as long as 8 days. Typical items shipped via cold chain packaging include pharmaceuticals, foodstuffs and similar perishable items.

Conventional cold chain packaging typically consists of an outer container, such as a corrugated carton, provided with a lining of either Styrofoam or resilient foam in the form of formed, molded or precut pads, and at least one pre-chilled gel pack, which is a sealed bag-like container of heavy plastic filled with a gel which freezes upon chilling and maintains a relatively low temperature in the container. An exemplary cold chain package is sold by TCP Reliable (www.tcpreliable.com) under the "Timesaver" brand. When a package is desired that has a longer cooling period, a larger outer container is provided, and more layers of foam and gel packs create a thicker insulated compartment.

Thus, current cold chain packaging is limited by size of the package and/or the length of time items can be kept cold. Also, conventional cold chain packages are largely single use, and as such are environmentally inefficient.

SUMMARY

The present cold chain package includes an arrangement of layers having dissimilar materials that keeps shipped items that need to be kept cold at a designated temperature for a longer period of time than existing packaging. This allows such items to be shipped via ground transportation, i.e., truck, as well as air transportation. The package is also reusable and has a compact design that saves space and minimizes the size of the shipping containers needed to ship items.

Specifically, the present cold chain package includes a plurality of panels surrounded by an overwrap, where each of the panels includes a plurality of layers of dissimilar materials. The package also includes a hinge formed between adjacent panels of the plurality of panels for facilitating folding of the panels to fit in a shipping container.

Another embodiment provides a method of making a cold chain package that includes providing corresponding rolls of dissimilar insulating packaging material, forming separate panels from sheets of dissimilar insulating packaging material provided by the corresponding rolls, enclosing the panels in a membrane where the membrane defines a hinge between the panels that are adjacent to each other, and folding the panels along each hinge to form a box-shaped chamber.

A further embodiment provides a method for distributing cold chain packaging that includes producing and assembling a cold chain package having a pre-printed address identifier that identifies a shipping location, inserting a cold chain package and an article to be delivered in a shipping container at the shipping location, the cold chain package maintaining the article at a desired temperature during shipping, delivering the shipping container to a designated location, returning the cold chain package to the shipping location identified by the pre-printed address identifier via a package courier and reusing the cold chain package in another shipping container.

DESCRIPTION OF THE PREFERRED EMBODIMENT

Figure 1:
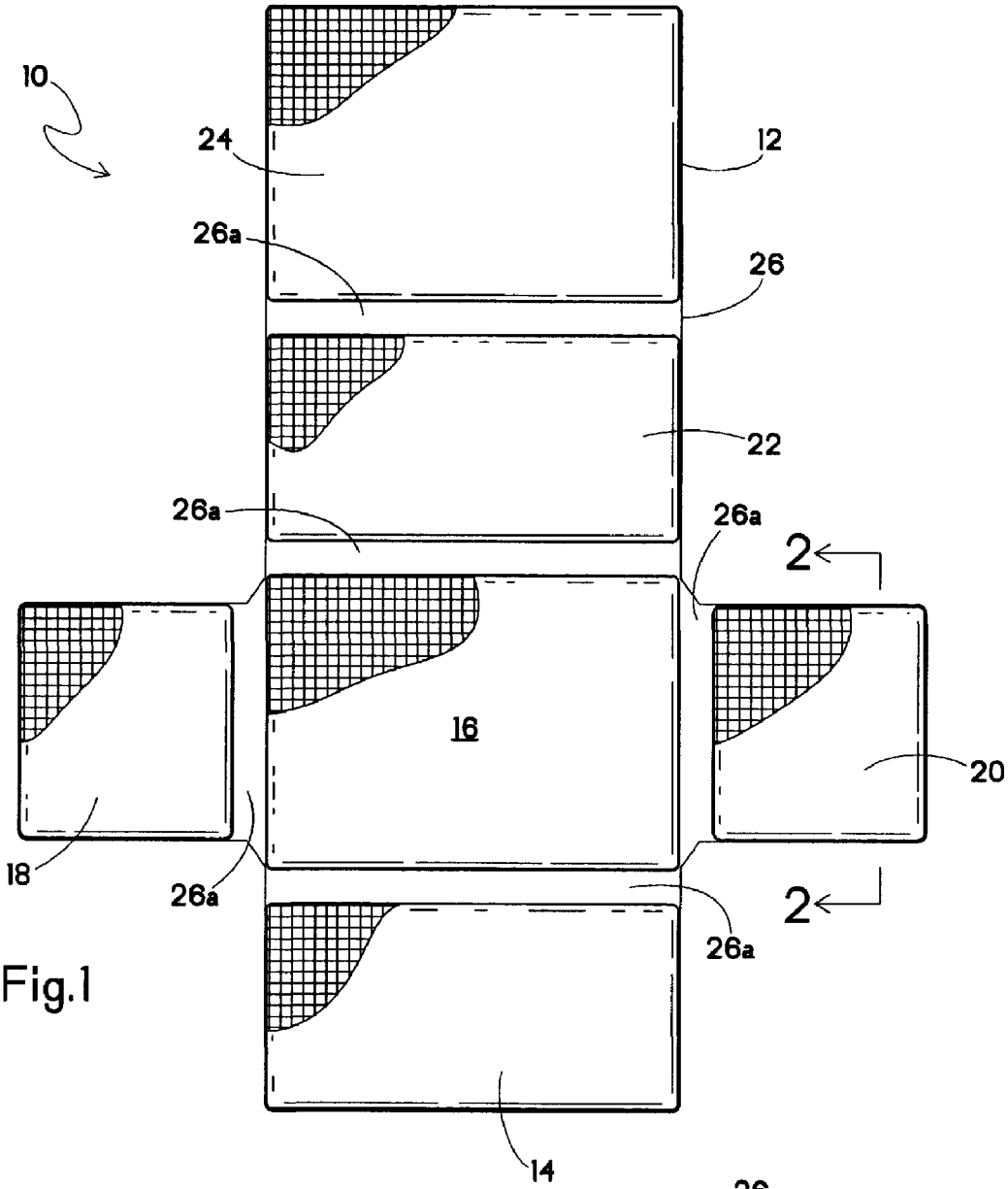
FIG. 1 is an overhead plan view of a disassembled package incorporating the present invention.
Figure 2:
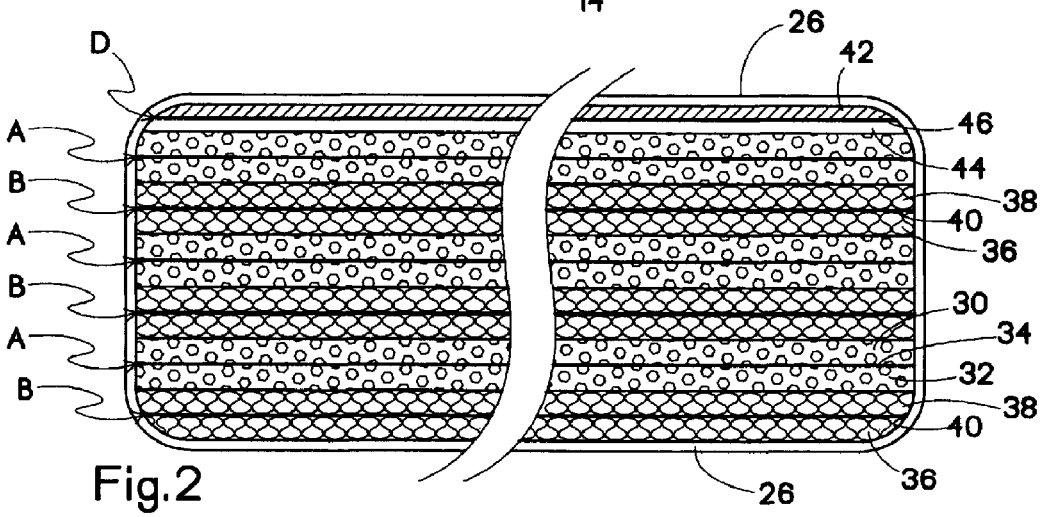
FIG. 2 is a schematic sectional view of the package of FIG. 1 taken along the line 2-2 of FIG. 1 in the direction generally indicated.
Figure 3:
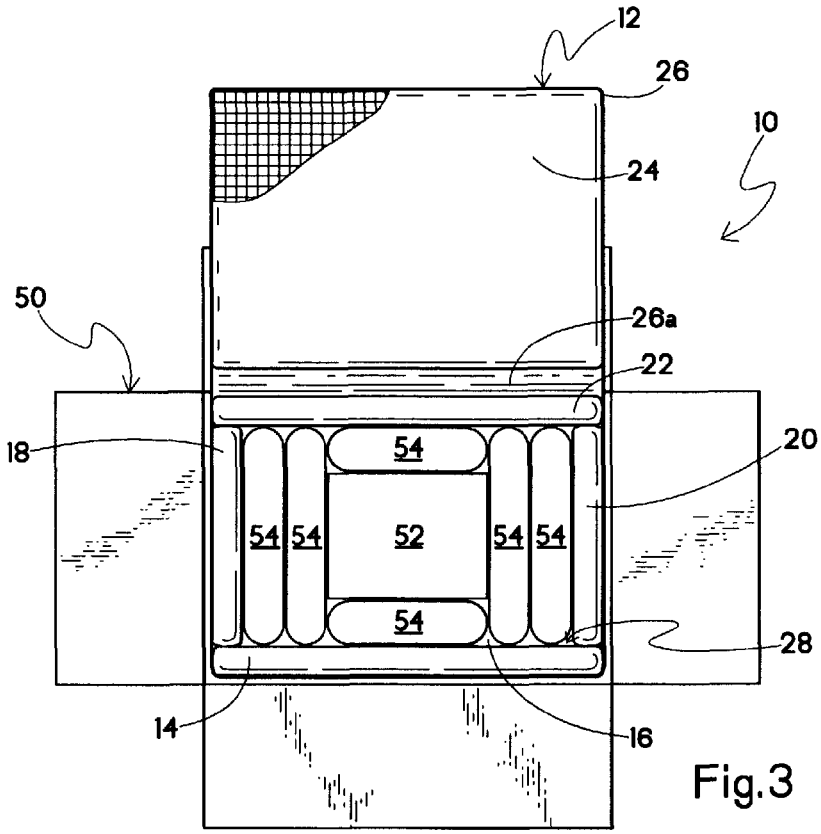
FIG. 3 is an overhead plan view of the present package shown assembled.

Referring now to FIGS. 1-3, the present composite cold chain package is generally designated 10 and is made of a web 12 formed, as by die cutting or similar technology into designated panels including front 14, bottom 16, left side 18, right side 20, rear 22 and top 24. Overlying each panel 14-24 is a bag-like membrane 26, preferably of a heavy gauge polyethylene overwrap that is heat sealed to form a hinge **26*a* between adjacent panels. It is contemplated that the overwrap material may change depending on the application. The hinge 26*a* facilitates the folding of the panels 14-24 into a box shape forming a cold-chain chamber 28. An advantage of the overwrap 26 is that, after each use, the package web 12** can be cleaned with disinfectant to address microbial growth resulting from condensation during shipment.

A feature of the present package 10 is that it occupies significantly less space than conventional cold chain packaging for obtaining a designated degree of insulation lasting a specified amount of time. This more efficient cooling power is achieved by creating a composite of dissimilar materials formed into each of the multi-layer panels 14-24. Some of the layers in the present package 10 are novel combinations of otherwise conventional packaging materials.

Referring now to FIG. 2, the preferred layers, which are schematically shown, include material A, including a combination of a sheet of aluminum foil 30 laminated to a corresponding sheet of Bubble Wrap® brand cushioning material 32, with a transition material 34 therebetween. Suitable cushioning material of this type is manufactured by Sealed Air Corp., www.sealedair.com under the trademark TEMP-SHIELD™. As is known in the plastic thermoforming arts, transition materials facilitate thermal bonding between otherwise dissimilar materials. A representative transition material 34 is a heat sealable polyethylene or polyvinylchloride (PVC). A second optional insulating layer is material B, including a combination of preferably polyethylene closed cell foam 36 to which is laminated a sheet of aluminum foil 38 with a transition layer 40 therebetween. Suitable material is also manufactured by Sealed Air Corp under the designation CA-250. It is preferred that the foil 38 face the interior of the package 10.

Still another optional layer is material C, which is approximately 1 inch thick foam, preferably closed cell polyurethane foam; however other foams are considered suitable and the thickness may vary. Yet another optional layer is material D, including a layer of Mylar® polyester film 42 laminated to a sheet of fiberfill synthetic filling material 44 with a transition layer 46 therebetween. In some cases, an additional layer of transition material (not shown) may be placed upon the Mylar® film 42 on the opposite side from the transition layer 46.

As seen in FIG. 2, the web 12 is preferably made of a composite of materials in layers as follows: DABABAB. It will be appreciated that the number, orientation and arrangement of layers may vary to suit the situation. It is also contemplated that at least some of the layers DABABAB may be secured to each other as by heat sealing, or the layers may be loosely contained within the overwrap 26.

Referring now to FIG. 3, upon assembly, the web 12 is folded into an outer container 50, typically a corrugated carton so that each of the panels 14-24 is associated with a panel of the container. The folded web 12 forms the cold chain chamber 28 into which an article to be shipped 52 is placed, preferably surrounded by pre-chilled gel packs 54. It has been found that the assembled panels, 14-24, each much thinner than conventional cold chain packaging, have a thickness in the range of 1.5-2.5 inches. It will be understood that the thickness may vary with the number of layers and the combination of composite materials selected. In any event, the package 10 is significantly thinner than conventional cold chain packages with similar temperature maintenance/insulation capabilities. Despite this relatively thin profile, the package 10 has been shown to retain a temperature of 48° F. for at least eight days.

Figure 4:
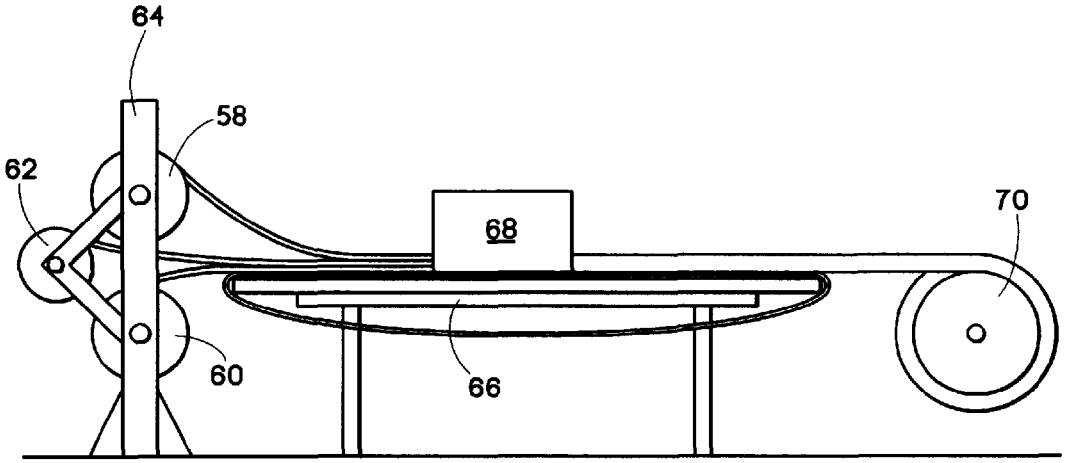
FIG. 4 is a schematic representation of a production line suitable for use in manufacturing the composite packaging material used in the present package.

Referring now to FIG. 4, a schematic of the production of the composite layers of materials A, B and D is shown. A supply of each of the insulating materials, such as foam, Bubble Wrap® cushioning material, aluminum foil, foam, Mylar® film, etc. is each provided in a respective roll 58, 60. The transition material 34, 40, 44, 46 is also provided in a roll 62. A rack 64 is created to arrange the rolls 58, 60, 62 so that the components of the composite material are arranged in a web format that is placed on a conveyor table 66 which conveys the layers to a heat source 68, where they are laminated together. After lamination, the composite material is placed upon a take up roll 70.

Figure 5:
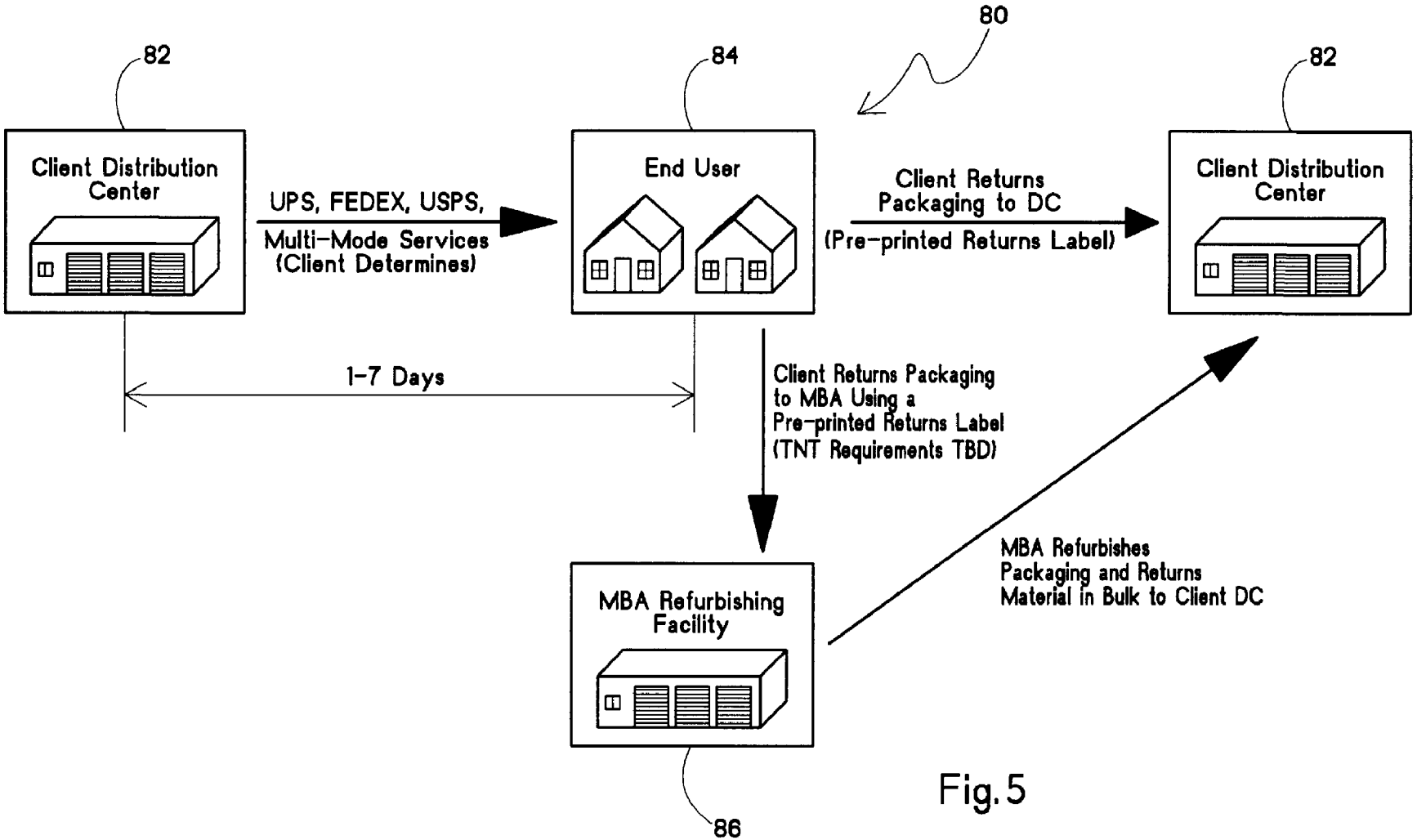
FIG. 5 is a schematic representation of a distribution system suitable for use with the present package.

Referring now to FIG. 5, besides having reduced weight and bulk compared to conventional cold chain packaging having similar temperature insulation qualities, another feature of the present package 10 is that it is reusable. A network of collection and refurbishing facilities is envisioned for facilitating the reuse of such packages, further reducing the cost to the shipper. The smaller size of the present package facilitates such shipment.

More specifically, the present network, generally designated 80, includes a Distribution Center 82 where the packages 10 are produced by assembling the webs 12 into packages and inserting the packaged articles 52. The packages 10 are shipped by courier, such as UPS, FedEx, USPS and the like to an end user 84. Due to the longer temperature retention properties of the present cold chain packaging, the shipping process can be extended to at least as long as 7 days. Thus, goods which previously had to be shipped by air can now travel by ground.

Since the packages 10 have preprinted return labels, bar code identification, RFID tags or similar identifiers, the end user 84 can return them to the Distribution Center 82, or to a Refurbishing facility 86, where the package is disassembled, checked for damage and reassembled as needed prior to reshipment in bulk to the Distribution Center 82. In this manner, the packaging is reused numerous times, reducing packaging and shipping cost compared to conventional cold chain packaging technology. Due to the identifiers, the Distribution Center 82 can grant credits, discounts, rewards or other incentives to the end user 84 to encourage return of the packages 10. Conversely, the same identifiers can be used so that the end user 84 is charged if the package 10 is not returned.

While a particular embodiment of the present cold chain package has been described herein, it will be appreciated by those skilled in the art that changes and modifications may be made thereto without departing from the invention in its broader aspects.

What is claimed is:

1. A cold chain package comprising:

a plurality of panels surrounded by an overwrap, each of said panels including a plurality of layers of dissimilar materials;

a hinge formed between adjacent panels of said plurality of panels for facilitating folding of said panels to fit in a shipping container; and said layers include a first layer made of a sheet of aluminum foil laminated to a sheet of cushioning material, a second layer made of polyethylene closed cell foam laminated to a sheet of aluminum foil and a third layer made of a polyester film laminated to a sheet of fiberfill filling material, said first, second and third layers being adjacent to each other.

2. The cold chain package of claim 1, wherein said layers in each of said panels are joined together using heat sealing.

3. The cold chain package of claim 1, wherein said layers in each of said panels are held together only by said overwrap and said overwrap forms said hinge.

4. The cold chain package of claim 1, wherein each of said panels has a thickness of 1.5 to 2.5 inches.

5. The cold chain package of claim 1, wherein said overwrap is made of polyethylene.

6. A cold chain package comprising:

a plurality of panels surrounded by an overwrap, each of said panels including a plurality of layers of dissimilar materials;

a hinge formed between adjacent panels of said plurality of panels for facilitating folding of said panels to fit in a shipping container; and wherein an order of said layers includes a first layer of polyester film laminated to fiberfill on an exterior, a second layer of foam laminated to foil, a third layer of cushioning material laminated to foil, a fourth layer of either foam or foam foil, a fifth layer of cushioning material laminated to foil, a sixth layer of foam laminated to foil and a seventh layer of cushioning material laminated to foil.

7. The cold chain package of claim 6, wherein each of said layers includes a transition layer made of at least one of a heat sealable polyethylene and polyvinylchloride.

8. A cold chain package comprising:

a plurality of panels surrounded by an overwrap, each of said panels including a plurality of layers of dissimilar materials;

a hinge formed between adjacent panels of said plurality of panels for facilitating folding of said panels to fit in a shipping container; and said layers in each of said panels include a first layer of polyester film laminated to a fiberfill synthetic filling material, a second layer of foil laminated to foam, a third layer of foam laminated to foil, a fourth layer of foil laminated to a cushioning material, a fifth layer of foam laminated to foil, a sixth layer of foil laminated to a cushioning material and a seventh layer of foam laminated to foil.

9. The cold chain package of claim 8, wherein each of said layers includes a transition layer made of at least one of a heat sealable polyethylene and polyvinylchloride.

* * * * *